US006094107A

United States Patent [19]

Lexa

[11] Patent Number: 6,094,107

[45] Date of Patent: Jul. 25, 2000

[54] AIR COOLED TERMINATION FOR TRANSMISSION LINES

[76] Inventor: Jefferson D. Lexa, 7694 Oak Hill Dr., Chesterland, Ohio 44026

[21] Appl. No.: 09/162,411

[22] Filed: Sep. 29, 1998

[51] Int. Cl.[7] ..... H01P 1/26

[52] U.S. Cl. ..... 333/22 R; 333/22 F

[58] Field of Search ..... 333/22 F, 22 R, 333/81 A; 338/216

[56] References Cited

U.S. PATENT DOCUMENTS

| | | | |
|---|---|---|---|
| 2,881,399 | 4/1959 | Leyton . | |
| 3,044,027 | 7/1962 | Chin et al. . | |
| 3,183,458 | 5/1965 | Goldfinger | 333/22 R |
| 3,213,392 | 10/1965 | Hedberg | 333/22 F |
| 3,521,186 | 7/1970 | Sharpe . | |
| 3,599,127 | 8/1971 | Krijger . | |
| 3,634,784 | 1/1972 | Lesyk et al. | 333/22 F |
| 4,516,088 | 5/1985 | Johnson et al. . | |
| 4,754,238 | 6/1988 | Schuller et al. | 333/22 F |

*Primary Examiner*—Paul Gensler
*Attorney, Agent, or Firm*—Carl A. Rankin; Rankin, Hill, Porter & Clark LLP

[57] ABSTRACT

A termination for a coaxial transmission line wherein an elongated central conductor is located in an enclosure or housing and is surrounded by a plurality of elongated resistor tubes. The central conductor is connected to the inner conductor of the transmission line and the resistor elements are connected to the outer conductor. The housing defines an inner flow chamber and a plurality of outer flow passages surrounding the inner flow chamber with the upper ends thereof communicating with the upper end of the inner flow chamber. A centrifugal blower is located at the bottom of each of the outer flow passages to generate an air flow upwardly and then through lateral ports into the upper end of the inner flow chamber, whereupon a flow proceeds downwardly in a turbulent vortex through the inner flow chamber to cool the resistor elements.

10 Claims, 3 Drawing Sheets

AIR COOLED TERMINATION FOR TRANSMISSION LINES

BACKGROUND OF THE INVENTION

This invention relates to high frequency electrical power transmission and especially to a reflectionless termination or dummy load for coaxial transmission lines, commonly called TEM lines. More particularly the invention relates to an air cooled type termination.

Frequently, in testing transmitters or in measuring RF power, it is necessary to terminate a TEM line in a reflectionless termination or dummy load. The termination must be capable of absorbing and dissipating the RF power being transmitted, in the form of heat. The problem of providing a reflectionless termination is very complex when the termination must dissipate power in the order of kilowatts. For example, a coaxial line or TEM line has predetermined physical dimensions that determine the electrical characteristics that must be matched by the termination in order to prevent undesirable reflection of radio frequency waves.

Among the types of TEM line terminations currently employed, many use a tapered conductor, or horn that is connected to the outer conductor of the coaxial line and that tapers logarithmically. One end of the horn contacts a cylindrical resistor that is connected to the inner conductor of the coaxial line. Due to the logarithmic taper and because the horn is connected to the resistor, this combination restricts the high power frequency response that may be obtained.

Since the size of the inner and outer conductors in a coaxial configuration determines the cutoff frequency as well as the impedance of the resulting TEM main mode of propagation, the overall diameter must remain as small as possible to extend the usable high frequency response of the device.

In terminations that utilize air cooling it is necessary to have a substantial flow rate for the air passing around the heated elements in order to achieve satisfactory heat dissipation. In such prior art devices, because the resistor is connected to the inner conductor of the transmission line, a limited surface area is provided for contact with the heat transfer medium.

The device of the present invention, however, provides a substantial improvement over these prior art devices, particularly as to its ability to absorb relatively large amounts of electromagnetic power, to dissipate the resulting heat in an efficient manner, and to maintain a high frequency response.

SUMMARY OF THE INVENTION

It is among the objects of the present invention to provide an improved reflectionless coaxial line termination capable of dissipating large amounts of electromagnetic power.

Another object of the invention is to provide a relatively small coaxial line termination enabling the dissipation of high frequency electromagnetic power on the order of kilowatts.

Still another object of the invention is to provide a coaxial line termination capable of dissipating relatively high amounts of electromagnetic power by using a more efficient air flow to accomplish the necessary heat transfer.

These and other objects and advantages are achieved by the novel coaxial line termination of the invention. The device includes a housing defining an inner flow chamber and a plurality of outer flow passages or plenums that communicate at the upper ends thereof with the inner chamber. Within the inner flow chamber is an elongated conductive member defining a surface of revolution about a central axis and having a generally logarithmic form.

The conductive member is electrically connected to the inner conductor of the transmission line. Surrounding the central member are a plurality of parallel elongated cylindrical elements formed of electrically resistive material. These members are uniformly spaced in a circular pattern around the central axis and are electrically connected to the outer conductor of the transmission line.

A plurality of centrifugal blowers are mounted on the housing at the lower end thereof and are adapted to generate an upward flow of air through the respective outer flow passages or plenums. The axes of the blowers are generally tangential to the central axis. When the flow of air in the outer passages reaches the upper ends thereof, it is forced radially inward through connecting ports to the inner flow chamber and is introduced therein in a direction generally tangential to the central axis. This generates a downward turbulent flow in the form of a vortex to the lower end of the inner flow chamber, thus creating a heat transfer relationship with the assembly of resistor elements.

This turbulent vortex provides an efficient heat transfer contact with the array of resistors so as to provide an efficient absorption of the electromagnetic energy in the form of heat. At the lower end of the inner flow chamber the heated air is exhausted through the bottom of the termination.

DETAILED DESCRIPTION OF PREFERRED EMBODIMENT

Figure 1:
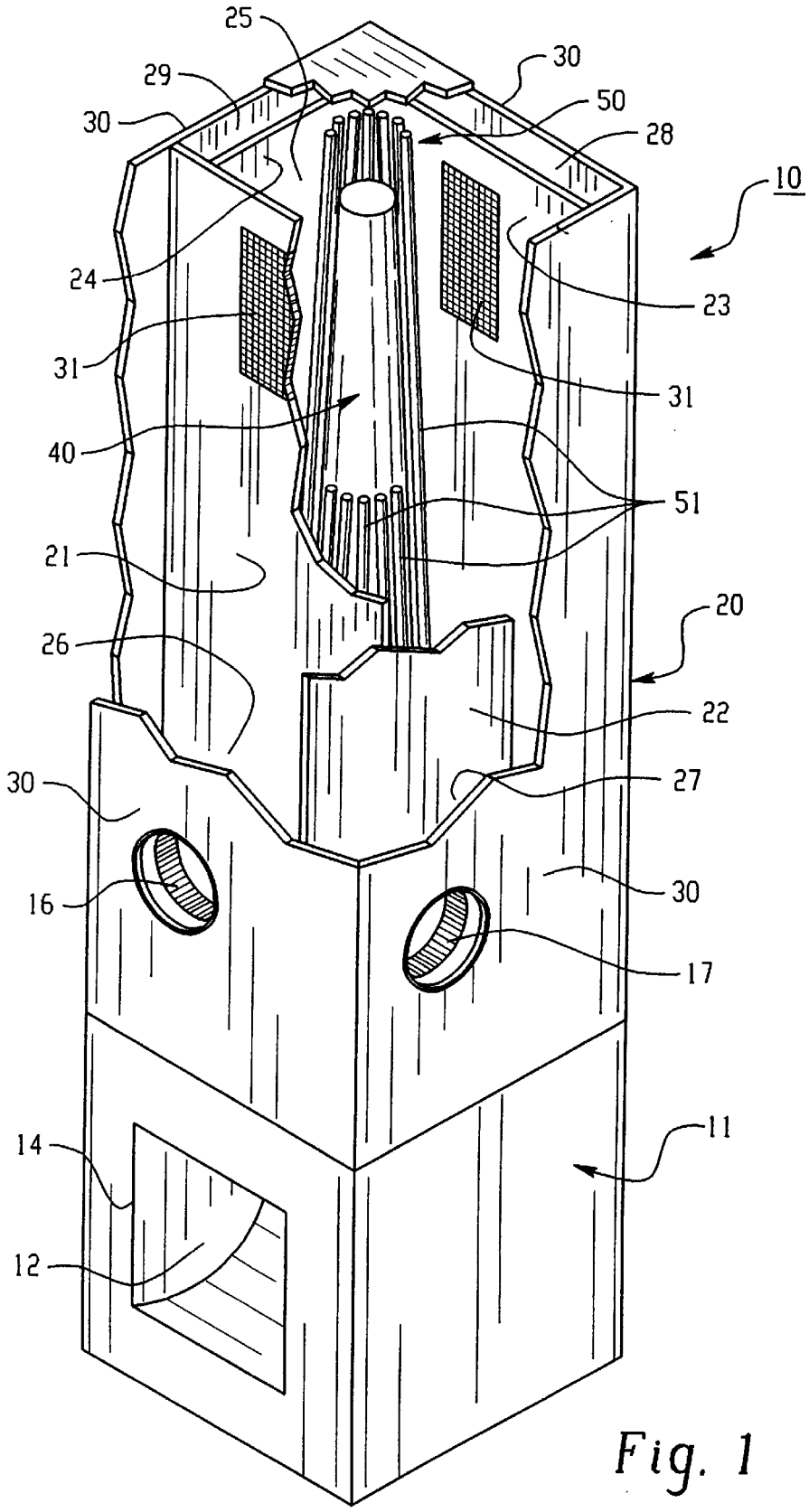
FIG. 1 is an isometric view of the coaxial line termination of the invention with parts broken away for the purpose of illustration.
Figure 2:
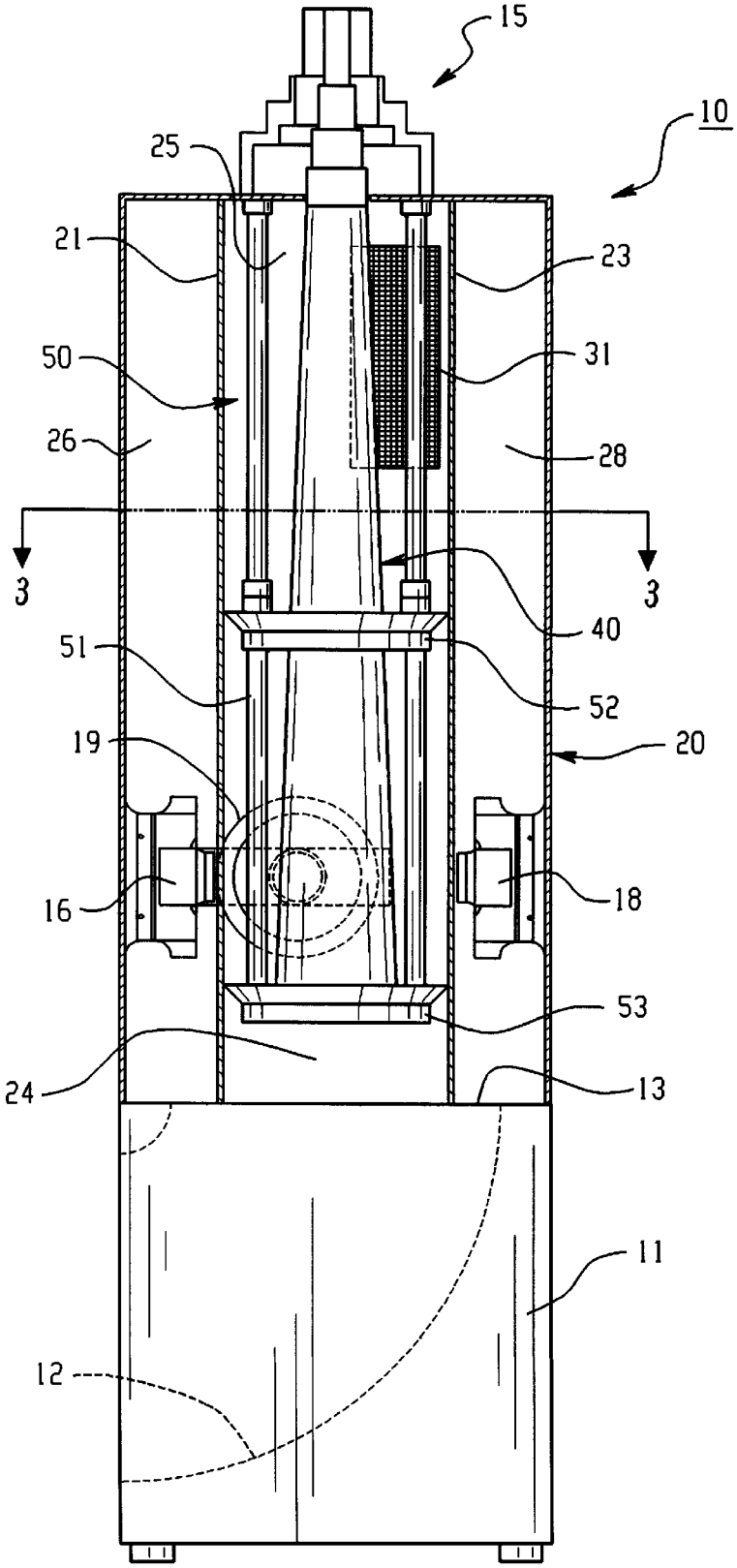
FIG. 2 is a broken side elevation of the coaxial line termination of FIG. 1.

Referring more particularly to FIGS. 1 and 2, there is shown an air cooled line termination 10 for dissipating power from a coaxial transmission line. The device has a base 11 formed of sheet metal, and that defines an air flow passage 12 of uniform cross-section that changes a downward flow of air from a vertical path to a generally horizontal path. Referring to FIG. 2, the passage 12 extends from the top 13 of the base 11 to an opening 14, shown in FIG. 1 in the side that provides an outlet port through which heated air is exhausted.

As shown in FIG. 1, the termination 10 includes as its primary components a housing 20, an elongated central conductor 40 and an outer conductor assembly 50 in the form of a plurality of elongated cylindrical elements formed of electrically resistive material.

The resistor elements are arranged in a circular pattern, uniformly spaced around the inner conductor element 40. Located at the top of the housing 20 is a coaxial coupling 15 to which a coupling on the end of a coaxial transmission line may be connected as shown in FIG. 2.

Referring to FIG. 2, the housing 20 has a generally square cross-sectional shape and has four vertical exterior side walls 30. Each side wall 30 has a centrifugal blower 16, 17, 18 and 19 with a backward inclined impeller, mounted therein as shown in FIGS. 1 and 2. The axis of each blower is horizontal and generally tangential to the central axis of the housing 20. The housing is generally formed of sheet metal panels including the exterior side walls, and a top plate.

Located within the housing 20 are four vertical partitions, 21, 22, 23, 24 (FIGS. 2 and 3) that divide the interior of the housing into an flow inner chamber 25 and four outer flow passages or plenums 26, 27, 28 and 29. Each of the plenums is defined by an outer wall of the housing, one of the partitions, and a portion of another partition.

Figure 3:
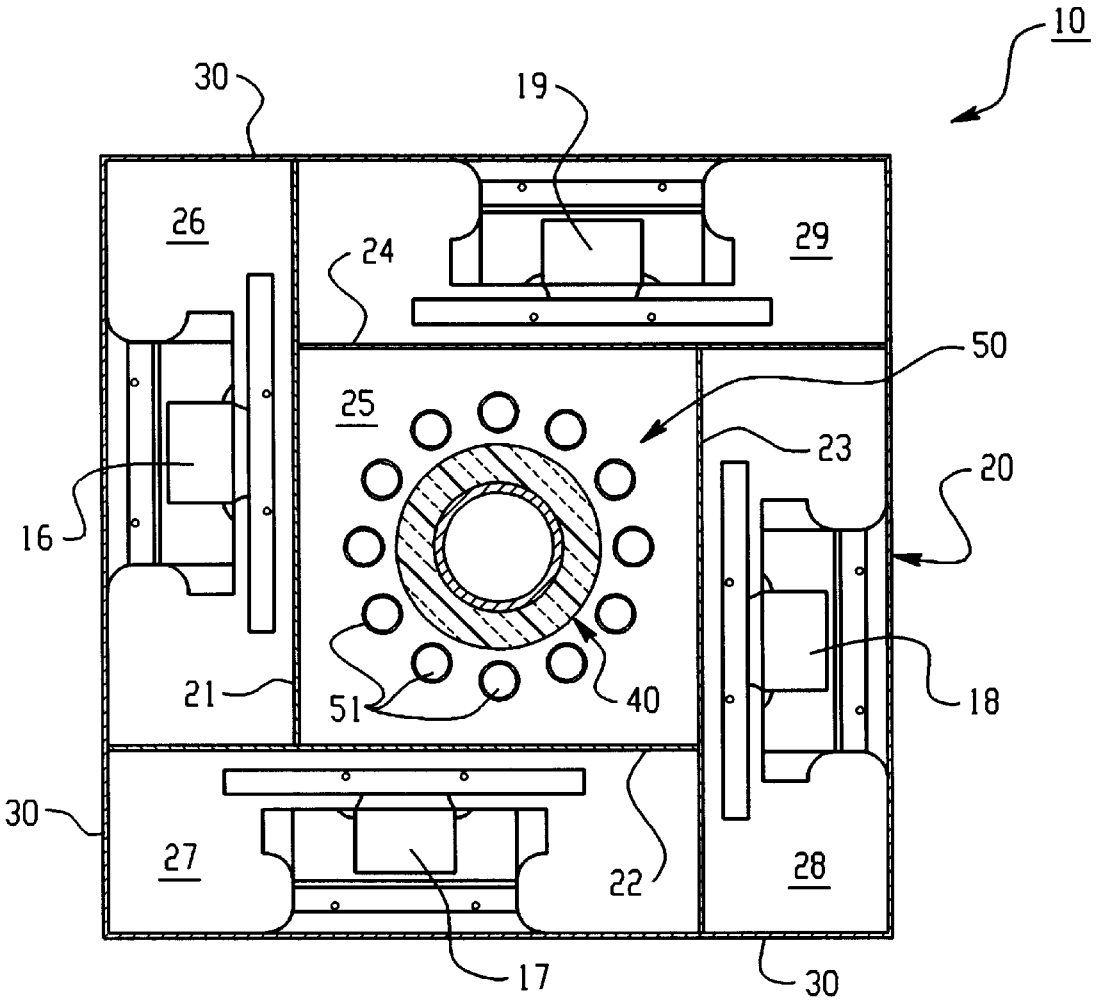
FIG. 3. is a sectional view taken on the line 3—3 of FIG. 2.

Accordingly, the plenums are uniformly spaced around the central axis of the housing 20 but are offset relative to the axis, as best shown in FIG. 3. One of the centrifugal blowers 16, 17, 18, 19 is located in each plenum 26, 27, 28, 29 at the bottom thereof and is adapted to generate an upward flow of air extending from near the bottom of the plenum to the top.

Located at the top of each plenum in the respective partition 21, 22, 23, 24 is an opening or port 31, that communicates with the inner flow chamber 25. The openings face in a tangential direction relative to the central axis of the housing. Accordingly, air that is forced upwardly in each plenum by the respective blower flows from the top of the plenum into the top of the inner flow chamber 25 through the respective opening 31.

The central conductor 40 is shaped to define a surface of revolution. The surface has a generally logarithmic shape as viewed in axial section and is formed of conductive material. Thus, the cross-section of the resulting conductor increases in a logarithmic manner from the upper end to the lower end.

The central conductor in the embodiment shown is formed of relatively thin metal sheet material to define an interior space. Also the sheet material is perforated to permit air flow through the resulting wall. This arrangement minimizes any restriction of air flow at the lower portion of the central flow chamber in view of the increasing diameter of the central conductor from its upper end to its lower end.

Also located within the inner flow chamber 25 is the outer conductor assembly 50. The assembly comprises an array of parallel resistive elements 51. Referring to FIG. 2, the elements are arranged in a circular pattern and are uniformly and symmetrically spaced from one another as shown in FIG. 3. They are maintained in position by a central spreader 52 and a lower spreader 53.

In the embodiment shown there are 12 parallel resistor elements 51 in the assembly and they are of tubular form. The resistors may be formed of a variety of well-known types of electrically resistive material. A relatively large surface area is provided for heat transfer from the surfaces of the resistor elements to the surrounding air flow. By maximizing the surface area large amounts of power can be dissipated even with a relatively low heat transfer coefficient, yet keeping the overall diameter at a minimum.

The lower ends of the resistor elements 51 may be selected so as to be connected to the conductive member 40, but they may also be isolated therefrom. Their upper and lower ends are electrically connected to the outer conductor of the coaxial transmission line through the central and lower spreaders 52 and 53.

The outer surface of the central conductor 40 and the inwardly facing surfaces of the partitions 21,22, 23, 24 define an inner flow passage in the chamber 25 with the resistor elements 51 located generally in the path of flow. The flow of air from the plenums 26, 27, 28, 29 into this inner flow passage through the ports 31 is induced in a generally tangential direction. This generates a turbulent vortex within the inner flow passage that proceeds downwardly in a swirling path to the lower end of the chamber 25. There the flow exits through the outlet passage 12 in the base 11. Due to the turbulent swirling flow, an optimum heat transfer is achieved so that a very efficient cooling of the resistor elements 51 is obtained.

By placing the resistor elements 51 on the outside of the coaxial configuration, the cooling air flow entry is in direct contact with the array of resistor elements to improve the heat transfer. In prior art configurations, the cooling medium must flow around the outside conductor in order to reach the resistive inner conductor thus reducing its effectiveness.

As another advantage of this arrangement, by placing the resistor elements 51 inside an air insulated enclosure, an extra level of electromagnetic shielding takes place due to the fact that the resistors themselves, the inner chamber walls and the outer plenum walls all act together to attenuate any electromagnetic fields that extend through the gaps between the resistor elements 51 which act as the initial outer conductor.

This air insulated enclosure also acts as a significant thermal barrier to the heat being dissipated within the chamber 25. Accordingly, the exterior walls of the housing 20 are kept relatively cool.

As indicated above this particular arrangement creates a vortex or a swirling effect from the four incoming air streams that converge from the respective plenums inside the inner chamber 25. The resulting turbulent flow around the circular array of resistors offers an improved coefficient of heat transfer as compared with the results achieved when the air flow is generally laminar. This swirling turbulent flow is particularly effective at the front of the array of resistor elements where the resistors become the hottest due to the orientation of instant power.

While the invention has been shown and described with respect to a specific embodiment thereof this is intended for the purpose of illustration rather than limitation and other variations and modifications of the specific device herein shown and described will be apparent to those skilled in the art, all within the intended spirit and scope of the invention. Accordingly, the patent is not to be limited in scope and effect to the specific device herein shown and described nor in any other way that is inconsistent with the extent to which the progress and the art has been advanced by the invention.

What is claimed is:

1. A termination for a coaxial transmission line comprising:

a housing having a central axis and defining an inner flow chamber having an upper end, and outer flow passages with upper ends communicating with said upper end of said inner flow chamber, an elongated central conductor located in said flow chamber, and being electrically connected to the inner conductor of said coaxial transmission line, a plurality of elongated resistor elements located in said inner flow chamber uniformly spaced around said central conductor, said elements being electrically connected to the outer conductor of said transmission line, and a plurality of blowers mounted in said housing, a respective blower being in the lower end of each of said outer flow passages, to generate an air flow in said outer flow passages upwardly to the upper ends thereof and then downwardly in a turbulent vortex through the inner flow chamber to cool the resistor elements.

2. A termination as defined in claim 1 wherein said central conductor defines a surface of revolution about said central axis and has a logarithmic taper that increases from the upper end to the lower end of said inner flow chamber.

3. A termination as defined in claim 2 wherein said central conductor has a thin exterior wall that defines an interior space within.

4. A termination as defined in claim 3 wherein said thin wall is perforated to permit air flow therethrough.

5. A termination as defined in claim 1 wherein said elongated resistor elements are cylindrical and are parallel to one another.

6. A termination as defined in claim 1 wherein said resistor elements are tubular.

7. A termination as defined in claim 1 wherein said pluarity of blowers are centrifugal blower.

8. A termination as defined in claim 7 wherein each centrifugal blower has a backward inclined impeller.

9. A termination as defined in claim 1 wherein the housing is provided with four vertical partitions between the outer flow passages and inner flow chamber that divide the interior of the housing into four outer flow passages and an inner flow chamber.

10. A termination as defined in claim 9 wherein each of said partitions has a respective port provided therein at an upper end thereof and to permit flow of air from the respective outer flow passage to the inner flow passage.

* * * * *